US008480217B2

(12) United States Patent
Morandotti et al.

(10) Patent No.: US 8,480,217 B2
(45) Date of Patent: Jul. 9, 2013

(54) INK JET CARTRIDGE HAVING AN INK CONTAINER COMPRISING TWO POROUS MATERIALS

(75) Inventors: Roberto Morandotti, Arnad (IT); Sergio Amato, Arnad (IT)

(73) Assignee: Telecom Italia S.p.A., Milan (IT)

( * ) Notice: Subject to any disclaimer, the term of this patent is extended or adjusted under 35 U.S.C. 154(b) by 677 days.

(21) Appl. No.: 12/303,085

(22) PCT Filed: May 31, 2006

(86) PCT No.: PCT/IT2006/000412

§ 371 (c)(1),
(2), (4) Date: Dec. 1, 2008

(87) PCT Pub. No.: WO2007/138624

PCT Pub. Date: Dec. 6, 2007

(65) Prior Publication Data

US 2009/0244220 A1 Oct. 1, 2009

(51) Int. Cl.
*B41J 2/175* (2006.01)

(52) U.S. Cl.
USPC ..... 347/86; 347/87

(58) Field of Classification Search
USPC .. 347/85, 86; 220/4.21, 4.27; 521/50; 442/61
See application file for complete search history.

(56) References Cited

U.S. PATENT DOCUMENTS

| | | | | |
|---|---|---|---|---|
| 4,771,295 | A | 9/1988 | Baker et al. | |
| 5,162,817 | A * | 11/1992 | Tajika et al. | 347/7 |
| 5,182,581 | A | 1/1993 | Kashimura et al. | |
| 5,237,342 | A * | 8/1993 | Saikawa et al. | 347/87 |
| 5,453,771 | A | 9/1995 | Waseda et al. | |
| 5,489,932 | A | 2/1996 | Ceshin et al. | |
| 5,623,291 | A * | 4/1997 | Morandotti et al. | 347/7 |
| 5,815,184 | A * | 9/1998 | Ujita et al. | 347/87 |
| 5,839,595 | A | 11/1998 | Ujita | |
| 6,015,210 | A | 1/2000 | Kanematsu et al. | |
| 6,045,207 | A * | 4/2000 | Mochizuki et al. | 347/7 |
| 6,550,898 | B2 * | 4/2003 | Hayashi et al. | 347/85 |
| 6,877,847 | B2 | 4/2005 | Hayashi et al. | |
| 2002/0001023 | A1 | 1/2002 | Ujita | |

FOREIGN PATENT DOCUMENTS

| | | |
|---|---|---|
| EP | 0 743 185 A1 | 11/1996 |
| EP | 1 106 363 A2 | 6/2001 |
| EP | 1 338 422 A2 | 8/2003 |

OTHER PUBLICATIONS

International Search Report mailed May 2, 2007, in PCT/IT2006/000412.

* cited by examiner

*Primary Examiner* — Anh T. N. Vo
(74) *Attorney, Agent, or Firm* — Venable LLP; Robert Kinberg; Steven J. Schwarz

(57) ABSTRACT

An ink jet cartridge comprising an ink container which comprises a bottom portion and an upper portion, said bottom portion being in communication with the printhead through an ink supply port, and said upper portion being in communication with a vent hole, wherein said bottom portion comprises a first ink absorbing member, and said upper portion comprises a second ink absorbing member, wherein said first ink absorbing member is a compressible porous material and said second ink absorbing member is an incompressible porous material, and wherein the capillarity of said first ink absorbing member is higher than the capillarity of said second ink absorbing member.

25 Claims, 4 Drawing Sheets

Fig. 2
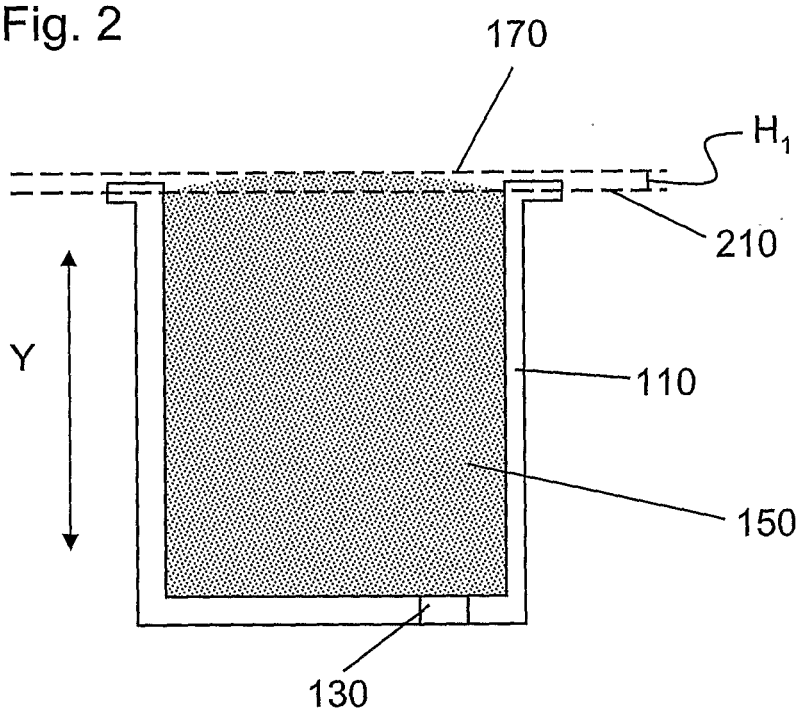
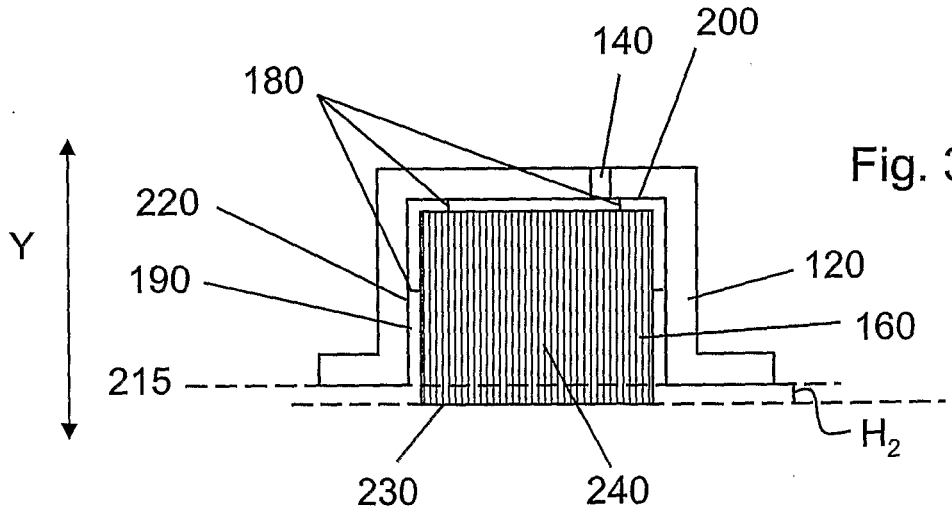
Fig. 3

INK JET CARTRIDGE HAVING AN INK CONTAINER COMPRISING TWO POROUS MATERIALS

BACKGROUND OF THE INVENTION

1. Field of the Invention

The present invention relates to an ink container, an ink jet cartridge comprising an ink container and a printhead, and a process for manufacturing thereof.

2. Description of Related Art

A conventional ink supply device is disclosed, for example, in U.S. Pat. No. 4,771,295. The ink supply device is a head integrated-type ink cartridge having an ink tank to which a print head for jetting ink is integrally mounted. A porous member impregnated with the ink is provided inside the ink tank. The ink tank is provided with an ink supply passage for communication between the print head and the inside of the ink tank. A filter is disposed at one end (an ink supply opening) of the ink supply passage opening into the ink tank. Further, the ink tank is provided with an atmospheric air communication hole for communication between the inside of the ink tank and atmospheric air. The ink cartridge is mounted on a carriage. The carriage is reciprocated, and simultaneously the print head is driven to jet the ink, thereby printing desired data on printing paper.

Thus, the porous member impregnated with the ink is enclosed in the ink tank. As compared with an ink cartridge that has only the ink enclosed in the ink tank, the above-mentioned ink cartridge with an open-type ink supply mechanism effectively prevents the leakage of the ink from the atmospheric air communication hole owing to the ink retentivity of the porous member. Furthermore, the ink cartridge buffers a pressure fluctuation in the ink tank caused by movement of the ink due to acceleration upon reciprocation of the carriage.

However, the amount of ink that can be contained in the ink tank is obviously reduced by the presence of the porous member and this, together with that the print head and the ink tank are integral with each other in the head integrated-type ink cartridge, reduce the useful life of a print head, thus increasing a running cost.

Merely making the ink jet cartridge tank larger in size is not a satisfactory solution to problems associated with frequent replacement of the ink jet cartridge. The ink jet cartridges are generally mounted on the moving print carriage of the ink jet printer. Therefore, the larger the volume of the tank in the ink jet cartridge, the greater the amount of weight that is required to be moved by the printer carriage holding the ink jet cartridges.

The additional weight of the ink jet cartridges will cause significant demands on the motor that drives the printer carriage. Performance is also limited by heavier print carriages because a larger carriage inertia must be overcome at the two endpoints of carriage motion. At these locations, the carriage reverses direction to begin another pass over the media during the printing process. Increased carriage inertia increases the time required to reverse direction for a given drive motor size, and therefore can reduce print speed.

U.S. Pat. No. 5,839,595 discloses an ink container for storing the ink to be supplied to an ink jet head which comprises an ink container shell having a first and a second shell portion, a porous member disposed in the ink container, having a first and a second porous member portion which are disposed within the first and the second portion, respectively; wherein the first shell portion containing the first porous member portion is provided with an ink supplying portion, at which the ink container is connected to the ink jet head; and the second container shell portion containing the second porous member portion is provided with an air vent; and the first and the second container shell portion are joined to form the ink container.

The ink container disclosed in such a patent has an irregular shape to fit in the space within an ink jet printer and to maximize the useful volume of the container. The irregular shape of the ink container either would cause the formation of dead space if using a porous member of regular shape or would require the use of expensive process to cut the porous member to the desired shape. According to the patent specification, by dividing the ink container shell into portions with a simple shape, a porous member with a simple shape matching the simple shape of each of the divided portions can be inserted in the corresponding divided portion, therefore, eliminating the above mentioned problems.

However, the Applicant has noticed that the use of two porous member portions to be separately pressed before closing the container creates an interface zone wherein the material of the porous members are highly compressed. The pores of such a highly compressed zone are then reduced in size, and, accordingly, the capillary force is highly increased, by creating a zone of preferential distribution of the ink contained in the ink container. The proper flow of ink to the ink jet head is then altered, with consequent bad working of the print head and ink waste due to the retention of ink around the interface zone.

The use of different foam materials having different porosity within the an ink container is generally known. For example, U.S. Pat. No. 5,182,581 and U.S. Pat. No. 6,015,210, disclose the use of different foam materials to reduce leakage of ink through the vent hole or to improve the ink supply flow from the ink container to the printing head. However, the assembly of ink containers comprising different foam materials requires the use of complex and expensive manufacturing processes as well as an accurate control of the raw material and the process parameters to avoid zone of undesired preferential collection of ink.

The use of fibers as the porous member in ink supply devices is generally known in the art.

For example, U.S. Pat. No. 5,489,932 discloses an ink container for an ink jet print head having a main tank, in communication with the print head, filled with an compressed absorbent fibrous material which holds ink by capillary action, and an auxiliary tank, fixed alongside the main tank, sharing a wall with the main tank, and communicates with it by a channel at that end of the main tank which has the feed channel. The container can be refilled by inserting ink through an aperture into the auxiliary tank, from where it passes into the main tank by capillary action.

U.S. Pat. No. 5,453,771 discloses an ink container comprising one or more compressed fibers having different density, wherein the fibers are arranged in such a manner that they are closely filled in the ink container and have an increase of fiber densities as they approach the ink feed passage.

U.S. Pat. No. 6,877,847 discloses an ink container comprising two ink absorbing members made of polyolefin fibers disposed perpendicularly each other to avoid deformation of the main ink absorbing member.

However, none of the above mentioned references discloses or suggests the specific combination of features of the present invention in order to solve the above mentioned problems.

SUMMARY OF THE INVENTION

The present invention provides an ink jet cartridge that can maximize the ratio between the ink volume and the tank volume.

The present invention also provides an ink jet cartridge that can improve the ink flow within the ink container.

Further, the present invention provides an ink jet cartridge that can reduce cost and improve ink volume.

In addition, the present invention provides an ink jet cartridge that can allow the use of different ink absorbing members without creating zone of preferential distribution of the ink.

As a consequence, the present invention provides an ink jet cartridge that can allow the proper and complete use of the whole amount of ink retained in the ink container.

The present invention provides for an ink jet cartridge (100) comprising an ink container (105) which comprises a bottom portion (110) and an upper portion (120), said bottom portion (110) being in communication with the printhead (135) through an ink supply port (130), and said upper portion (120) being in communication with a vent hole (140), wherein said bottom portion (110) comprises a first ink absorbing member (150), and said upper portion (120) comprises a second ink absorbing member (160), wherein said first ink absorbing member (150) is a compressible porous material and said second ink absorbing member (160) is an incompressible porous material, and wherein the capillarity of said first ink absorbing member (150) is higher than the capillarity of said second ink absorbing member (160).

According to another aspect, the present invention provides a process for manufacturing an ink jet cartridge able to reduce the manufacturing costs, and to improve the speed of loading of the ink absorbing member in the upper portion of the ink container.

Accordingly, the present invention also provides for a process for manufacturing an ink jet cartridge (100) comprising an ink container (105) which comprises the following steps:

to provide an upper portion (120) of said ink container (105) being in communication with a vent hole (140) and able to contain a second ink absorbing member (160), to provide a bottom portion (110) of said ink container (105) being in communication with the printhead (135) through an ink supply port (130) and able to contain a first ink absorbing member (150) having a capillarity higher than the capillarity of said second ink absorbing member (160) and higher than the pressure head of said ink jet cartridge (100), to insert in said bottom portion (110) said first ink absorbing member (150) comprised of a compressible porous material allowing the upper surface (170) of said first ink absorbing member (150) to have a convex shape protruding over the surface plane (210) of said first ink absorbing member (150), to insert in said upper portion (120) said second ink absorbing member (160) comprised of an incompressible porous material allowing the bottom surface (230) of said second ink absorbing member (160) to protrude from the contact plane (215) of said upper portion (120) with said bottom portion (110), and to join together said bottom and upper portions (110, 120) so as to allow the bottom surface (230) of said second ink absorbing member (160) to contact the upper surface (170) of said first ink absorbing member (150) and to protrude below the surface plane (210) of said first ink absorbing member (150).

The terms "bottom" and "upper" as referred herein to the portions of the ink container 105 as well as to the surfaces of the first and second ink absorbing members 150, 160 must be understood relatively to the working position of the fully assembled ink jet cartridge 100 as represented in FIG. 1. It must also be understood that both terms are used for improving the understanding of this description and are not used to limit, in absolute terms, the scope of the description and claims.

BRIEF DESCRIPTION OF THE DRAWINGS

FIG. 2 is a section view of the first embodiment of the upper portion 120 of the ink container 105 of the present invention.

FIG. 3 is a section view of the first embodiment of the bottom portion 110 of the ink container 105 of the present invention.

DETAILED DESCRIPTION OF THE INVENTION

Figure 1:
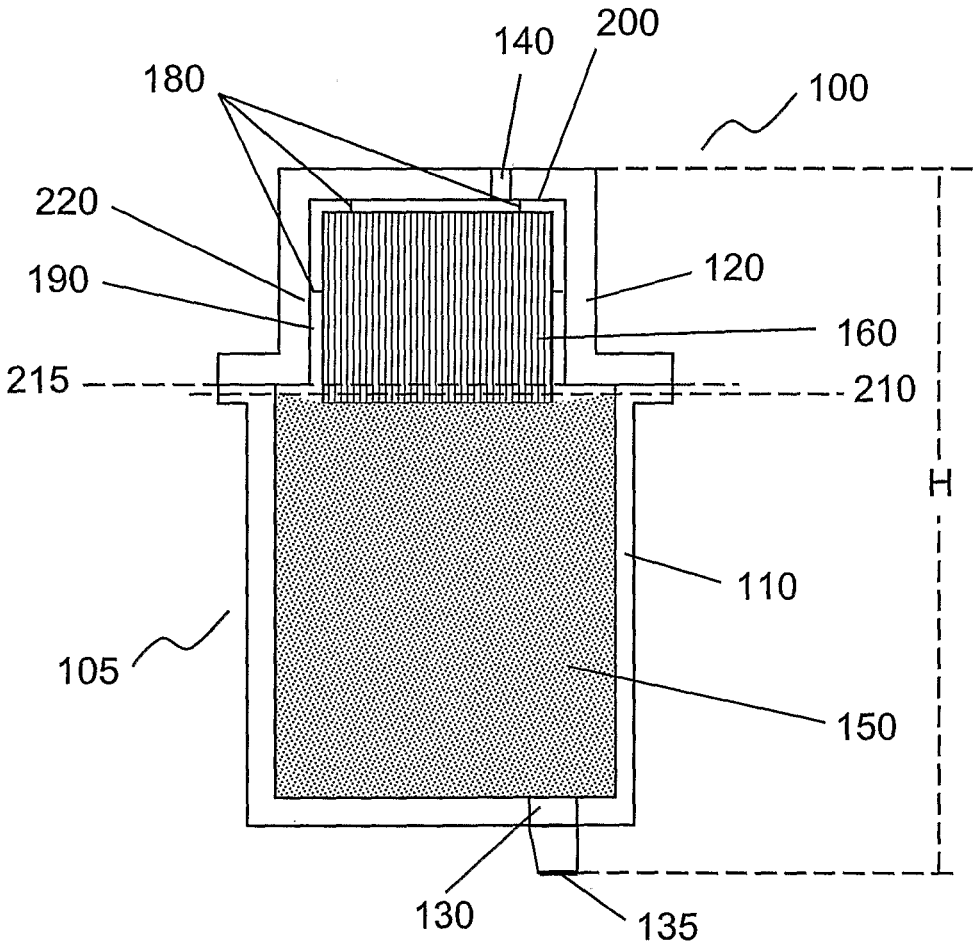
FIG. 1 is a section view of the first embodiment of the ink jet cartridge 100 of the present invention.

Referring now to FIG. 1, there is shown an ink jet cartridge 100 having an ink container 105 comprising a bottom portion 110 and an upper portion 120 and a printhead 135. The bottom portion 110 is provided with a ink supply port 130 through which the ink reaches the printhead 135. The upper portion 120 is provided with a vent hole 140 through which air can penetrate within the ink container 105.

The embodiment in FIG. 1 depicts an ink container 105 and a printhead 135 that are integrated into a single ink jet cartridge 100. The ink jet cartridge 100 which includes the ink container 105 and the printhead 135 is then replaced when ink within the ink container 105 is exhausted. The present invention is also applicable to inkjet printing systems having other configurations than those shown in FIG. 1. For example, the ink container 105 and the printhead 135 can be each separately replaceable. The ink container 105 is replaced when exhausted and the printhead 135 is replaced at the end of worklife.

The ink container 105 and printhead 135 shown in FIG. 1 contain a black ink or a single color ink. Alternatively, the ink container 105 can be partitioned into three separate chambers with each chamber containing a different color ink. In this case, three printheads are required with each printhead 135 in fluid communication with a different chamber within the ink container 105. Other configurations are also possible, such as more or less chambers associated with the ink container 105 as well as partitioning the printhead and providing separate ink colors to different partitions of the printhead 135.

The printhead 135 can typically include a thin film resistor (TFR) substrate having a plurality of heater resistors therein, and a barrier layer and orifice plate member can usually be mounted on top of the thin film resistor substrate.

The bottom portion 110 comprises a first ink absorbing member 150 made of a compressible porous material. The term "compressible porous material" as used herein means that the pressure needed to reduce of 2.5% the height (i.e., at least one dimension) of a cuboid of such a porous material is lower than 250 g/cm$^2$. Preferably, the compressible porous material useful in the present invention requires a pressure lower than 150 g/cm$^2$ to reduce of 2.5% the height of a cuboid made of such a material. More preferably, the compressible porous material useful in the present invention requires a pressure lower than 100 g/cm$^2$ to reduce of 2.5% the height of a cuboid made of such a material. The measure of the above mentioned values was made by using an Instron™ 5564 apparatus (available from Instron Corporation, Norwood, Mass.) equipped with a compression platen having a diameter of 15 cm pressing on a cuboid of porous material 39 mm long, 30 mm wide and 48 mm high. The speed of the compression platen has been preferably set up at 1 mm per minute and the measure has been done at room temperature.

Useful examples of compressible porous material include solid foam materials. The choice of the kind of foam comprised in the solid foam material useful in the present invention is not particularly limited. Useful examples of foam materials include foams made of polyurethane, polyvinylalcohol, polyether, melamine resin, polystyrene, neoprene, polyolefine, such as polyethylene or polypropylene, polyester, and mixture thereof. The generally preferred foam useful in the present invention is a polyurethane-polyether foam material having a porosity of from 50 to 500 pores per inch. Each pore has a polyhedral shape, generally a dodecahedron, with polygonal faces, typically pentagonal faces, formed by a thin membrane delimited by strands. The foam material of the first ink absorbing member 150 has been treated to break the thin membranes of the pores within the foam to allow the flow of the ink amongst the pores. The capillarity of the foam material depends on the number of pores per unit volume. In particular, the higher the number of pores per unit volume, the higher the capillarity. Also, the capillarity depends on the pore size. In this case, the higher the pore size, the lower the capillarity. In order to introduce the foam material within the bottom portion 110, the foam material is generally compressed. The compression reduces the pore size of the foam material and consequently reduces its volume while increasing its density. In this manner, the desired capillarity of the foam material can be controlled. By the compression process, the capillary force of the foam material is increased. Referring now to FIG. 2, after insertion within the bottom portion 110 by means of an automatic apparatus known in the art, the upper surface 170 of the first ink absorbing member 150 assumes a convex shape due to the combined action of the attitude of the foam material to expand and return to its original volume and the static friction of the foam material pressing against the internal side walls of the bottom portion 110 opposing such an attitude. The height $H_1$ represents the distance of the top of the convex portion from the surface plane 210 of the first ink absorbing member 150. According to a preferred aspect of the invention, the height $H_1$ of the convex portion protruding above the surface plane 210 must be lower than 3 mm, preferably lower than 2 mm, and most preferably lower than 1 mm. The surface plane 210 of the first ink absorbing member 150 is defined as the plane passing through the area delimited by the contact line of the convex portion with the internal side walls of the bottom portion 110. As can be seen in FIG. 1, the surface plane 210 is below the contact plane 215 through which the bottom portion 110 and the upper portion 120 are contacted to form the ink container 105. According to a preferred embodiment, the distance of the surface plane 210 from the contact plane 215 is equal to or lower than 3 mm, more preferably equal to or lower than 2 mm, and most preferably equal to or lower than 1 mm.

Referring now to FIG. 3, the upper portion 120 comprises a second ink absorbing member 160 made of a incompressible porous material. The term "incompressible porous material" as used herein means that the pressure needed to reduce of 2.5% the height (i.e., at least one dimension) of a cuboid of such a porous material is higher than 500 g/cm$^2$. The measure of the above mentioned values was made by using an Instron™ 5564 apparatus (available from Instron Corporation, Norwood, Mass.) equipped with a compression platen having a diameter of 15 cm pressing on a cuboid of porous material 24.5 mm long, 19 mm wide and 20 mm high. The speed of the compression platen has been preferably set up at 1 mm per minute and the measure has been done at room temperature.

Useful examples of incompressible porous material include fibrous material. The fibrous material can be made of a bundle of fibers arranged substantially parallel each other and packed so as to create interstitial channels among adjacent fibers extending for the whole length of the fibrous material. Alternatively, the fibrous material can be made of a single fiber that is wrapped back upon itself.

As compared to foam materials, the fibrous materials are easier to assemble into cartridges, allow for high speed assembly of ink containers and provide high levels of ink containers performance uniformity. Additionally, the fibrous material is much more easily compressible in a direction substantially perpendicular to the direction of the fibers than in the direction substantially parallel to the fiber direction. In this way, the density of the fibers, and accordingly their capillarity, can be controlled. The density of the fibrous material can range from 0.040 to 0.400 g/cm$^3$, preferably from 0.060 to 0.300 g/cm$^3$, and more preferably from 0.080 to 0.200 g/cm$^3$.

The choice of the kind of fiber comprised in the fibrous material useful in the present invention is not particularly limited. Natural and synthetic fibers can be used. Useful examples of natural fibers include fibers made of cotton, linen, jute, flax, ramie, sisal and hemp. Useful examples of synthetic fibers include fibers made of cellulose acetate, polyester, poyolefine (such as polyethylene, polypropylene, and the like), polyamide, polyacrylic, polyacrylate, polyacrylonitrile, and mixture thereof. Polyamide, polyester and polyolefine fibers are preferably employed in the practice of the present invention. Commercial products based on polyamide fibers are, for example, nylon 66, nylon 610, nylon 612, nylon 11, nylon 12. Commercial products based on polyester and/or polyolefine fibers are, for example, Transorb™ fibers sold by Filtrona Plc.

Bicomponent fibers having a core and sheath structure, such as those having a polyester or polyolefinic core (typically, polypropilene) and a polyester or polyethylene sheath, are also particularly useful in the practice of the present invention.

The core-sheath bicomponent fibers are preferably fused to each other to define a three-dimensional porous substrate wherein the core-sheath bicomponent fibers are bonded together at points of contact. Such bonding forms a self-sustaining structure. Preferably, the core material and the sheath material are different with the sheath material having a higher melting temperature than the core material.

These fibers are preferably formed of bicomponent fibers having a sheath formed of a) polyester such as polyethylene terephthalate (PET) or a co-polymer thereof, b) low density polyolefin such as low density polyethylene (LDPE), or c) thermoplastic polyurethane and a core material formed of a low cost, low shrinkage, high strength thermoplastic polymer, preferably polybutylene terephthalate or polypropylene.

The network of fibers are preferably formed using a melt blown fiber process. For such a melt blow fiber process, it may be desirable to select a core material of a melt index similar to the melt index of the sheath polymer. Using such a melt blown fiber process, the main requirement of the core material is that it is crystallized when extruded or crystallizable during the melt blowing process. Therefore, other highly crystalline thermoplastic polymers such as high density polyethylene terephthalate, as well as polyamides such as nylon and nylon 66 can also be used. Polypropylene is a preferred core material due to its low price and ease of processability. In addition, the use of a polypropylene core material provides core strength allowing the production of fine fibers using various melt blowing techniques. The core material should be capable of forming a bond to the sheath material as well.

The fibers of the fibrous material can be physically bonded or fused together by conventional means known in the art, e.g., by the use of heat and/or pressure. Heat bonding of a typical fiber bundle can be achieved by heating the fiber bundle at about 120° C. to about 250° C. for about ½ minute to about 5 minutes.

Figure 6:
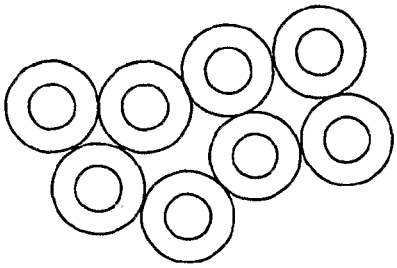
FIG. 6 is a section view of the fibers constituting the fibrous material of FIG. 5.
Figure 7:
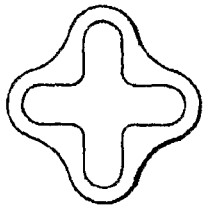
FIG. 7 is a section view of an alternative x-shape of the fibers constituting the fibrous material of FIG. 5.
Figure 8:
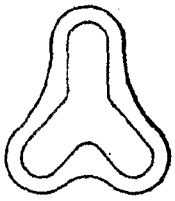
FIG. 8 is a section view of an alternative y-shape of the fibers constituting the fibrous material of FIG. 5.

In a section view, as shown in FIG. 6, the fibers of the fibrous material can have a circular or quasi-circular shape with a core portion and a sheath portion surrounding it. However, the fibers of the fibrous material can have different shape, such as a cross or x-shape as illustrated in FIG. 7, a multi-lobal shape, an y-shape as illustrated in FIG. 8, an h-shape, a T-shape, and the like. Several examples of bicomponent fibers useful for the purpose of the present invention are described, for example, in U.S. Pat. Nos. 5,607,766, 5,620,641, and 5,633,082.

The second ink absorbing member 160 is shaped to fit the internal sides, in terms of length and width, of the upper portion 120 which is provided by a plurality of at least two ribs 180 to allow the formation of spaced portions 190 between the internal ceiling 200 and the second ink absorbing member 160 as well as between the internal side walls 220 and the second ink absorbing member 160. The plurality of at least two ribs 180 facilitates the insertion of the second ink absorbing member 160 during the assembly of the ink jet cartridge 100. Further, the spaced portions 190 allow the passage of air from the vent hole 140 into the ink container 105. The second ink absorbing member 160 is disposed within the upper portion 120 so as the fibers 240 of the fibrous material are arranged substantially parallel to the internal side walls 220 of upper portion 120 and substantially perpendicular to the contact plane 215. By the term "substantially parallel" is meant that the fibers can form with the side walls of upper portion 120 and each other an angle within the range of ±30°, preferably ±20°, and more preferably ±10°. By the term "substantially perpendicular" is meant that the fibers can form with the contact plane 215 an angle within the range of from 60° to 120°, preferably from 70° to 110°, and more preferably from 80° to 100°. The length of the fibers are depending upon the length of the fibrous material and in turn from the dimensions of the upper portion 120 of the ink container 105. The cross-section of each fiber has an equivalent diameter lower than 100 μm, preferably lower than 50 μm, more preferably lower than 20 μm. The equivalent diameter is the diameter of a circle having the same area of the cross-section under consideration.

The second ink absorbing member 160 is dimensioned in such a way to have its bottom surface 230 protruding below the contact plane 215 of the upper portion 120, so as to contact, in the finished ink jet cartridge 100, the upper surface 170 of the first ink absorbing member 150. The height $H_2$ of the protrusion is determined in order to have, in the finished ink jet cartridge 100, a penetration of the second ink absorbing member 160 into the first ink absorbing member 150.

Figure 4:
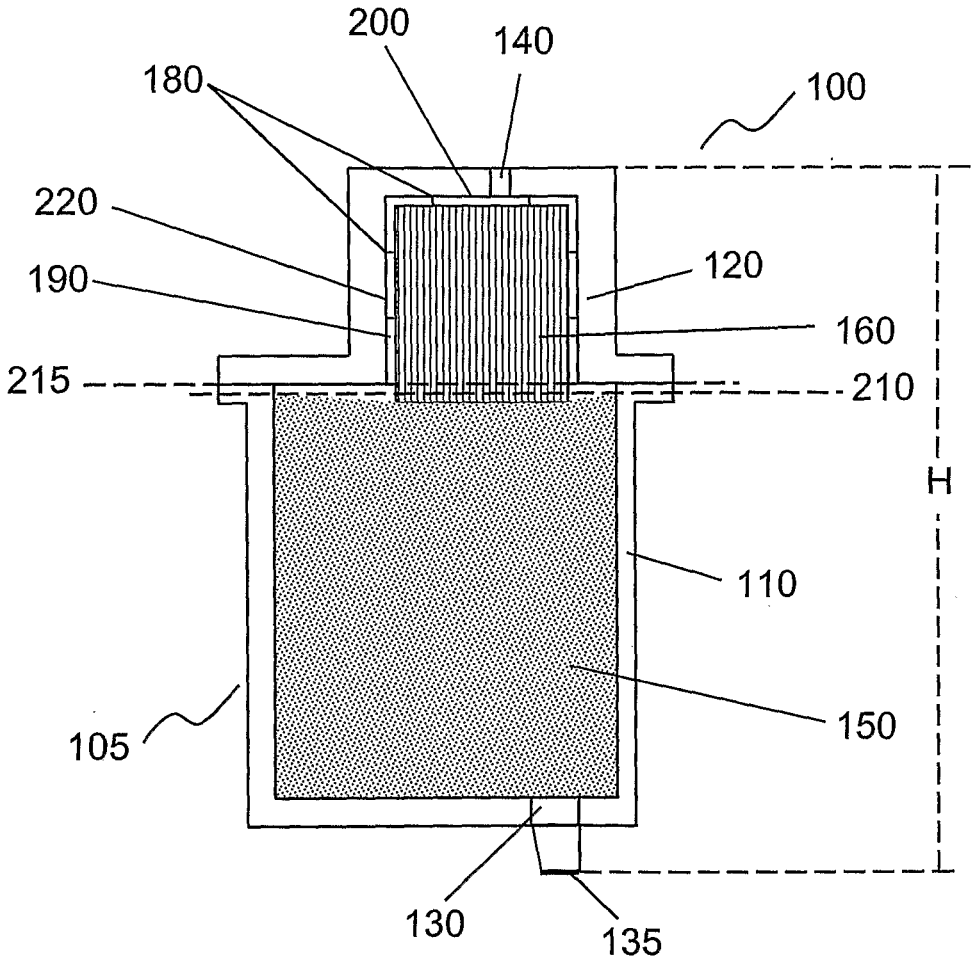
FIG. 4 is a section view of the second embodiment of the ink jet cartridge 100 of the present invention.
Figure 5:
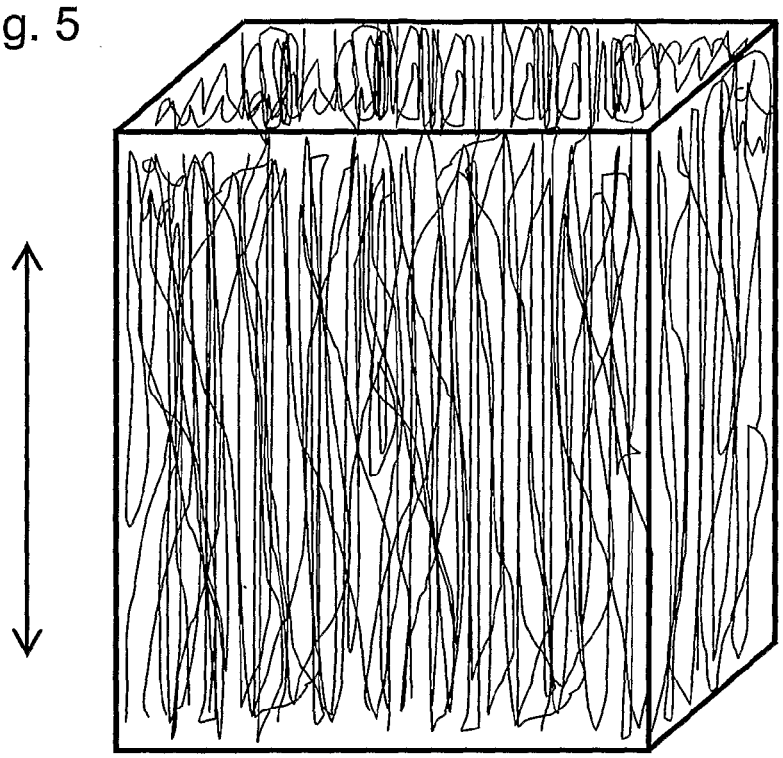
FIG. 5 is a perspective view of the second ink absorbing member 160 comprising fibrous material.

Referring now to FIG. 4, representing a second embodiment of the present invention, the volume of the upper portion 120 has been reduced. The shape of the upper portion 120 can be manufactured in the manner illustrated in FIG. 4 for several reasons, such as, for example, in order to fit the ink jet cartridge 100 in the space available in an inkjet printer. The formation of a stepped shape can allow to maximize the useful volume for the ink container 105, and in turn, to maximize the amount of ink available for the ink jet cartridge 100. The consequence of the reduced volume of the upper portion 120 is that the volume of the second ink absorbing member 160 is also reduced as well as is reduced the area of its bottom surface 230. All other features of the ink jet cartridge 100 of the present invention, including its assembly and its working, remains unaltered.

According to the present invention, the capillarity of the first ink absorbing member 150 is higher than the capillarity of the second ink absorbing member 160.

According to a preferred aspect of the present invention the capillarity of the first ink absorbing member 150 has a value of at least 1 $cmH_2O$, more preferably at least 2 $cmH_2O$, and most preferably at least 3 $cmH_2O$ higher than the capillarity of said second ink absorbing member 160. On the other hand, in order to retain the ink within the ink jet cartridge 100 and avoid any leakage of ink during storage conditions, the capillarity of both the first and second ink absorbing members 150, 160 must be higher than the pressure head of the ink jet cartridge 100. Preferably, the capillarity of both the first and second ink absorbing members 150, 160 has a value of at least 1 $cmH_2O$, more preferably at least 2 $cmH_2O$, and most preferably at least 3 $cmH_2O$ higher than the pressure head of the ink jet cartridge 100. The pressure head of the ink jet cartridge 100 is equivalent to the hydrostatic pressure generated by a column of water having the same height H of the ink jet cartridge 100.

In a practical example, assuming for the height H of the ink jet cartridge 100 the typical value of 6 cm, the pressure head of the ink jet cartridge 100 would be 6 $cmH_2O$. Accordingly, the capillarity of both the first and second ink absorbing members 150, 160 must be higher than 6 $cmH_2O$. Preferably, the capillarity of the second ink absorbing member 160 is at least 7 $cmH_2O$, more preferably at least 8 $cmH_2O$, and most preferably at least 9 $cmH_2O$. As a consequence, the capillarity of the first ink absorbing member 150 preferably ranges from a minimum value of at least 8 $cmH_2O$ to a more preferred value of at least 10 $cmH_2O$, and to a most preferred value of at least 12 $cmH_2O$.

During assembly, the first ink absorbing member 150 is inserted into the bottom portion 110 so that its compressible direction is substantially parallel to the longitudinal axis Y of the bottom portion 110. The first ink absorbing member 150 is preferably inserted into the bottom portion 110 by means of an apparatus able to first compress the foam material to a size smaller than the internal size of the bottom portion 110, then to insert the foam material into the bottom portion 110, and finally to release the foam material to contact the internal side walls of the bottom portion 110. In its uncompressed state, the foam material is a rectangular parallelepiped (cuboid) having a size larger than the internal size of the bottom portion 110. Usually, the foam material cuboid has a height ranging from 40 to 60 mm, and typically from 45 to 55 mm, a width ranging from 25 to 45 mm, and typically from 30 to 40 mm, and a length ranging from 30 to 50 mm, and typically from 35 to 45 mm. The compression ratio between the uncompressed size and the compressed size within the bottom portion 110 is chosen depending on the porosity of the foam material and the desired capillarity of the foam material in the final product. Preferably, the linear compression ratio for each dimension ranges from 1.05 to 1.35, more preferably from 1.10 to 1.30, and most preferably from 1.15 to 1.25. Preferably, the volume compression ratio for the foam material cuboid ranges from 1.15 to 2.45, more preferably from 1.30 to 2.20, and most preferably from 1.50 to 1.90.

As explained above, after insertion of the foam material within the bottom portion 110, the upper surface 170 of the first ink absorbing member 150 assumes a convex shape due to the combined action of the attitude of the foam material to expand and return to its original volume and the static friction of the foam material pressing against the internal side walls of the bottom portion 110 opposing such an attitude. As already mentioned, according to a preferred aspect of the invention, the height $H_1$ of the convex portion protruding above the surface plane 210 must be lower than 3 mm, preferably lower than 2 mm, and most preferably lower than 1 mm.

During assembly, the second ink absorbing member 160 is inserted into the upper portion 120 so that its uncompressible direction is substantially parallel to the longitudinal axis Y of the upper portion 120. The second ink absorbing member 160 is preferably inserted into the upper portion 120 by means of an automatic apparatus able to pick and insert in the proper position the second ink absorbing member 160 into the upper portion 120. The fibrous material of the second ink absorbing member 160 need not to be compressed during insertion and its size fits the internal size, in terms of length and width, of the upper portion 120. On the internal side of the upper portion 120 a plurality of at least two ribs 180, preferably at least three ribs 180, and more preferably at least four ribs 180 is realized in order to facilitate the introduction of the second ink absorbing member 160 into the upper portion 120 and to leave spaced portions 190 between the internal ceiling 200 and the second ink absorbing member 160 as well as between the internal side walls 220 and the second ink absorbing member 160. As already explained, the second ink absorbing member 160 has a height dimensioned in such a way to have its bottom surface 230 protruding below the contact plane 215 and contacting, in the finished ink jet cartridge 100, the upper surface 170 of the first ink absorbing member 150. The height $H_2$ of the protrusion is determined in order to have, in the finished ink jet cartridge, a penetration of the second ink absorbing member 160 into the first ink absorbing member 150. According to a preferred aspect of the invention, the height $H_2$ of the protrusion of the bottom surface 230 below the contact plane 215 must be equal to or lower than 5 mm, preferably equal to or lower than 4 mm, and most preferably equal to or lower than 3 mm.

During assembly, the upper portion 120 containing the second ink absorbing member 160 is joined with the bottom portion 110 containing the first ink absorbing member 150. The joint can be made by means of gluing, ultrasonic welding, heat welding, and the like, in order to seal the upper and bottom portions 120, 110 each other. In this way, the second ink absorbing member 160, made of the fibrous material described above, contact the first ink absorbing member 150, made of the foam material described above. In consideration of the relative protrusion of both the first and second ink absorbing members 150, 160, as described above, a compression force CF is generated between the upper surface 170 of the first ink absorbing member 150 and the bottom surface 230 of the second ink absorbing member 160.

Such a compression force CF is not sufficient to cause any deformation of the second ink absorbing member 160. In other words, under this compression force CF the second ink absorbing member 160 is substantially undeformable and can be considered a rigid body. Accordingly, the capillarity of the second ink absorbing member 160 is not altered by the compression force CF acting on it during the assembly operations.

On the contrary, the compression force CF is more than enough to cause compression of the first ink absorbing member 150. Accordingly, the second ink absorbing member 160 will contact and penetrate the first ink absorbing member 150 as shown in FIG. 1 or in FIG. 4. In consideration of the height $H_2$ of the protrusion of the second ink absorbing member 160, the first ink absorbing member 150 is pressed and its upper surface 170 is substantially planarized against the bottom surface 230 of the second ink absorbing member 160. The value of the height $H_2$, as described above, is determined so as to guarantee the proper contact between the first and second ink absorbing members 150, 160, which provides a fluidic connession between the first ink absorbing member 150 and the second ink absorbing member 160 and a continuous flow of ink from the second ink absorbing members 160 to the first ink absorbing members 150. On the other hand, the value of the height $H_2$ is also determined so as to avoid any excessive pressure on the upper surface 170 of the first ink absorbing member 150. If the height $H_2$ is higher than the above mentioned values, the upper surface 170 of the foam material would be excessively pressed, with a reduction of the pore size and the consequent excessive increase of the capillarity.

According to a preferred aspect of the invention, the protrusion of the bottom surface 230 of the second ink absorbing member 160 below the surface plane 210 of the first ink absorbing member 150 must be equal to or lower than 2.5 mm, preferably equal to or lower than 2 mm, and most preferably equal to or lower than 1.5 mm.

The invention claimed is:

1. An ink jet cartridge comprising an ink container which comprises:

a bottom portion and an upper portion, said bottom portion being in communication with a printhead through an ink supply port, and said upper portion being in communication with a vent hole, said bottom portion comprising a first ink absorbing member having a first surface plane, and said upper portion comprising a second ink absorbing member having a second surface plane, wherein said first ink absorbing member is a compressible porous material and said second ink absorbing member is an incompressible porous material, wherein the capillarity of said first ink absorbing member is higher than the capillarity of said second ink absorbing member, wherein the first surface plane and the second surface plane are contacted along a contact plane through which the bottom portion and the upper portion are contacted to form the ink container, and wherein said upper portion comprises on its internal sides a plurality of ribs extending in the internal sides of said upper portion down to the contact plane between the bottom portion and the upper portion to form spaced portions between the internal sides of said upper portion and said second ink absorbing member allowing passage of air from said vent hole to the first ink absorbing member.

2. The ink jet cartridge according to claim 1, wherein said compressible porous material is a solid foam material.

3. The ink jet cartridge according to claim 2, wherein said solid foam material is selected from the group consisting of polyurethane, polyvinylalcohol, polyether, melamine resin, polystyrene, neoprene, polyolefine, polyester, and mixture thereof.

4. The ink jet cartridge according to claim 1, wherein said incompressible porous material is a fibrous material.

5. The ink jet cartridge according to claim 4, wherein said fibrous material is selected from the group consisting of natural and synthetic fibers.

6. The ink jet cartridge according to claim 5, wherein said synthetic fibers are selected from the group consisting of synthetic fibers having a core and sheath structure.

7. The ink jet cartridge according to claim 6, wherein said core is made of a material selected from the group of polyester and polyolefin.

8. The ink jet cartridge according to claim 6, wherein said sheath is made of a material selected from the group of polyester, polyolefin and polyurethane.

9. The ink jet cartridge according to claim 4, wherein the density of said fibrous material ranges from 0.040 to 0.400 $g/cm^3$.

10. The ink jet cartridge according to claim 4, wherein the fibers of said fibrous material are arranged substantially parallel to the side walls of said upper portion.

11. The ink jet cartridge according to claim 4, wherein the fibers of said fibrous material are arranged substantially perpendicular to the contact plane of said upper portion with said bottom portion.

12. The ink jet cartridge according to claim 1, wherein the bottom surface of said second ink absorbing member protrudes below the surface plane of said first ink absorbing member.

13. The ink jet cartridge according to claim 1, wherein said capillarity of said first ink absorbing member is at least 1 cm $H_2O$ higher than said capillarity of the second ink absorbing member.

14. The ink jet cartridge according to claim 1, wherein the capillarity of said first ink absorbing member is higher than the pressure head of said ink jet cartridge.

15. The ink jet cartridge according to claim 14, wherein said capillarity of said first and second ink absorbing members has a value of at least 1 cm $H_2O$ higher than the pressure head of said ink jet cartridge.

16. The ink jet cartridge according to claim 1, wherein the capillarity of said second ink absorbing member is higher than said pressure head of said ink jet cartridge.

17. The ink jet cartridge according to claim 16, wherein said capillarity of said first and second ink absorbing members has a value of at least 1 Cm $H_2O$ higher than the pressure head of said ink jet cartridge.

18. The ink jet cartridge according to claim 1, wherein the bottom surface of said second ink absorbing member protrudes below the contact plane of said upper portion with said bottom portion.

19. The ink jet cartridge according to claim 1, wherein the capillarity of said first ink absorbing member is higher than the capillarity of said second ink absorbing member.

20. A process for manufacturing an ink jet cartridge comprising an ink container, comprising:

providing an upper portion of said ink container being in communication with a vent hole and able to contain a second ink absorbing member, providing a bottom portion of said ink container being in communication with a printhead through an ink supply port and able to contain a first ink absorbing member having a capillarity higher than the capillarity of said second ink absorbing member and higher than the pressure head of said ink jet cartridge, inserting in said bottom portion said first ink absorbing member comprised of a compressible porous material allowing an upper surface of said first ink absorbing member to have a convex shape protruding over a surface plane of said first ink absorbing member, inserting in said upper portion said second ink absorbing member comprised of an incompressible porous material allowing a bottom surface of said second ink absorbing member to protrude from a contact plane of said upper portion with said bottom portion, and joining together said bottom and upper portions so as to allow the bottom surface of said second ink absorbing member to contact the upper surface of said first ink absorbing member and to protrude below the surface plane of said first ink absorbing member, wherein providing an upper portion of said ink container in communication with a vent hole comprises forming spaced portions in its internal sides extending in the internal sides of said upper portion down to the contact plane between the bottom portion and the upper portion to allow the passage of air from the vent hole to the first ink absorbing member.

21. The process for manufacturing of an ink jet cartridge according to claim 20, wherein the height of said convex portion protruding above said surface plane is lower than 3 mm.

22. The process for manufacturing of an ink jet cartridge according to claim 20, wherein the distance of said surface plane from said contact plane is equal to or lower than 3 mm.

23. The process for manufacturing of an ink jet cartridge according to claim 20, wherein the height of the protrusion of said bottom surface below said contact plane is equal to or lower than 5 mm.

24. An ink container comprising:

a bottom portion and an upper portion, said bottom portion comprising a first ink absorbing member having a first surface plane, and said upper portion comprising a second ink absorbing member having a second surface plane, wherein said first ink absorbing member is a compressible porous material and said second ink absorbing member is an incompressible porous material, wherein the capillarity of said first ink absorbing member is higher than the capillarity of said second ink absorbing member, wherein the first surface plane and the second surface plane are contacted along a contact plane through which the bottom portion and the upper portion are contacted to form the ink container, and wherein said upper portion includes on its internal sides a plurality of ribs extending in the internal sides of said upper portion down to the contact plane between the bottom portion and the upper portion to form spaced portions between the internal sides of said upper portion and the second ink absorbing member and allow the passage of air from a vent hole to the first ink absorbing member.

25. The ink container according to claim 24, wherein said bottom portion is provided with an ink supply port.

* * * * *